US006384522B1

(12) United States Patent
Tani et al.

(10) Patent No.: US 6,384,522 B1
(45) Date of Patent: May 7, 2002

(54) COLOR CATHODE RAY TUBE FOR REDUCING LANDING DRIFT OF ELECTRON BEAMS ON PHOSPHOR LAYERS

(75) Inventors: Munechika Tani; Takashi Murai, both of Fukaya; Ichiro Saotome, Urawa; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/180,616

(22) PCT Filed: Mar. 12, 1998

(86) PCT No.: PCT/JP98/01048

§ 371 Date: Nov. 12, 1998

§ 102(e) Date: Nov. 12, 1998

(87) PCT Pub. No.: WO98/42003

PCT Pub. Date: Sep. 24, 1998

(30) Foreign Application Priority Data

Mar. 14, 1997 (JP) ..... 9-060283

(51) Int. Cl.[7] ..... H01J 29/80
(52) U.S. Cl. ..... 313/402; 313/407
(58) Field of Search ..... 313/402, 403, 313/404, 405, 406, 408, 407; 430/26, 27

(56) References Cited

U.S. PATENT DOCUMENTS

| | | | | |
|---|---|---|---|---|
| 2,795,718 A | * | 6/1957 | Van Hekken et al. | 313/408 |
| 3,808,493 A | * | 4/1974 | Kawamura et al. | 313/407 |
| 3,809,945 A | * | 5/1974 | Roeder | 313/402 |
| 4,767,962 A | | 8/1988 | Adler et al. | 313/402 |
| 4,859,901 A | * | 8/1989 | Thompson-Russell | 313/403 |
| 6,051,918 A | * | 4/2000 | Hayashi et al. | 313/407 |
| 6,111,346 A | * | 8/2000 | Ito et al. | 313/402 |

FOREIGN PATENT DOCUMENTS

| | | | | |
|---|---|---|---|---|
| FR | 2151051 | | 4/1973 | |
| FR | 2218648 | | 9/1974 | |
| FR | 2756971 | | 6/1998 | |
| JP | 60232642 | A | 11/1985 | 313/402 |
| JP | 62-96250 | | 6/1987 | |
| JP | 62-119838 | | 6/1987 | |
| JP | 2-72545 | A | 3/1990 | 313/402 |
| JP | 4-47649 | A | 2/1992 | 313/326 |
| JP | 5-74326 | | 3/1993 | |
| JP | 6-139949 | | 5/1994 | |
| JP | 8-298078 | A | 11/1996 | |
| JP | 9-35657 | | 2/1997 | |
| JP | 409320481 | * | 12/1997 | |

OTHER PUBLICATIONS

Patent Abstracts of Japan, Publication Number 08298078, Nov. 12, 1996.

* cited by examiner

*Primary Examiner*—Ashok Patel
*Assistant Examiner*—Mariceli Santiago
(74) *Attorney, Agent, or Firm*—Pillsbury Winthrop LLP

(57) ABSTRACT

A main body 34 of a shadow mask is opposed to a phosphor screen and is formed in a substantially rectangular shape. The main body 34 has a main surface portion 31 where a number of electron beam apertures are formed, and a skirt portion 33 provided around the main surface portion with a non-aperture portion 32 interposed between the skirt portion and the main surface portion. A plurality of rectangular openings 38*a* extending in the long axis direction (or X-direction) of the mask body are formed at the skirt portion. Concave portions 47 extending in the long axis direction (X-direction) of the mask body are formed at the non-aperture portion. The openings and concave portions are provided within a range of about ¼ of the length W of the mask body in the long axis direction, with respect to a center of the range defined at a position distant from the short axis Y by about ⅓ of the length W of the long axis direction of the mask body.

11 Claims, 6 Drawing Sheets

COLOR CATHODE RAY TUBE FOR REDUCING LANDING DRIFT OF ELECTRON BEAMS ON PHOSPHOR LAYERS

This application is the international application PCT/JP98/01048 filed Mar. 12, 1998 which designated the U.S.

TECHNICAL FIELD

The present invention relates to a color cathode ray and particularly to a color cathode ray tube which restricts a landing displacement of electron beams on a phosphor layer caused by thermal expansion of a shadow mask.

BACKGROUND ART

In general, a color cathode ray tube comprises a vacuum envelope, which includes a face panel having a substantially rectangular effective portion in form of a curved surface, and a funnel connected with the face panel. A phosphor screen made of a three-color phosphor layer which radiates in blue, green, and red is formed on the effective portion of the face panel. A shadow mask is arranged inside the phosphor screen with a predetermined distance maintained from the face panel. The shadow mask comprises a substantially rectangular mask body and a substantially rectangular mask frame equipped at a peripheral portion of the mask body.

The mask body comprises a main surface portion having a number of electron beam apertures formed in a predetermined array and made of a curved surface opposed to the phosphor screen, a non-aperture portion surrounding the main surface portion, and a skirt portion provided around the main surface portion with the non-aperture portion interposed therebetween. The mask frame is formed to have a L-shaped cross-section and is welded to the skirt portion of the mask body.

Meanwhile, an electron gun which emits three electron beams is provided in the neck of the funnel. The three electron beams emitted from the electron gun are deflected by a magnetic field generated by a deflector equipped outside the funnel so as to scan horizontally and vertically the phosphor screen, thereby forming a color image.

In a color cathode ray tubes constructed in a structure as described above, and particularly, in an inline type color cathode ray tube having an electron gun which emits three electron beams arranged in line and running on one same horizontal plane, the three-color phosphor layers are formed of strip-like layers elongated in the vertical direction (or short axis direction or Y-axis direction) perpendicular to the tube axis (or Z-axis). On the other hand, electron beam apertures are arranged such that rows each consisting of a plurality of apertures aligned in the vertical direction and the rows are disposed in the horizontal direction (or long axis direction or X-axis direction).

The shadow mask is provided to select three electron beams, which pass through beam apertures at different angles respectively, so that the electron beams land on predetermined phosphor layers. Further, in order to obtain excellent color purity of an image displayed on the phosphor screen by scanning by respective electron beams, three electron beams passing through the electron beam apertures must correctly land on predetermined phosphor layers, respectively. The mask body therefore must be correctly positioned and aligned in a predetermined relationship to the phosphor screen, and the relationship must be maintained during operation of the color cathode ray tube. In particular, the distance (or q-value) between the inner surface of the effective portion of the face panel and the main surface portion of the mask body must be maintained within a predetermined tolerable range.

However, from operational principles of a color cathode ray tube, those electron beams that pass through electron beam apertures of the mask body and reach the phosphor screen are ⅓ in amount of the entire electron beams emitted from the electron gun, and most of the rest of the electron beams collide with the mask body and are converted into thermal energy, thereby heating the mask body to about 80° C. Therefore, the surface portion of the mask body locally expands toward the phosphor screen due to thermal expansion, i.e., so-called doming occurs, particularly in case of a shadow mask whose mask body is mode of a cold-rolled plate having a large thermal expansion coefficient ($1.2\times 10^{-6}$/° C.) and thickness of 0.1 to 0.3 mm, and whose mask frame is made of a cold-rolled plate having a thickness of about 1 mm and having a greater mechanical strength than the mask body. Consequently, the distance between the inner surface of the effective portion and the main surface of the mask body exceeds a tolerable value, and landing of electron beams onto the three-color phosphor layers is displaced thereby deteriorating color purity.

There are two types of landing drift of electron beams on the three-color phosphor layers, one being landing drift which occurs due to thermal expansion of the entire mask body in the initial period when the color cathode ray tube is started operating, and the other being landing drift due to localized doming which occurs when a high-luminance image is displayed locally. The amount of landing drift differs depending on the luminance of an image pattern displayed on the screen, the duration thereof, and the like. For example, when a high-luminance image is displayed on the entire screen, deterioration of color purity occurs over a large area of the screen. When a high-luminance image is displayed locally, localized doming of the shadow mask occurs and landing positions are greatly drifted in a short time period, resulting in localized deterioration of color purity.

Landing drift due to localized doming is the greatest at an elliptic area in a middle portion of the phosphor screen in the horizontal direction when a high-luminance pattern is displayed at a position which is distant from the center of the screen by about ⅓ W where the length of the phosphor screen in the horizontal direction is expressed as W.

Conventionally, several measures have been developed to restrict landing drift caused by doming of the mask body. For example, the following (a) and (b) are known as techniques for restricting landing drift in the initial period of staring operation of a color cathode ray tube.

(a) According to the technique disclosed in U.S. Pat. No. 2,826,538, a graphite layer containing graphite as a main component is provided on the surface of a main surface a mask body and is used as a radiator for decreasing the temperature of the mask body, in order to promote thermal radiation of a mask body.

(b) Japanese Patent Application KOKAI Publication 60-54139 discloses a mask body in which a glass layer made of lead-borate glass or the like is formed on the surface of a main surface portion of the mask body facing an electron gun. If a lead-borate glass layer is thus provided, less calories are transmitted to the mask body since the thermal conductivity of the layer is smaller than that of the mask body, and therefore, an increase of the temperature of the mask body can be restricted. In addition, by providing a lead-borate glass layer, the mechanical strength of the mask body is improved. Further, if the lead-borate glass is welded to the mask body and crystallized, a compressive stress acts on the glass layer and a tensile stress acts on the mask body, so that the tensile strength of the mask body is improved.

It is also possible to restrict localized doming of the mask body by the techniques as described above.

In addition, the following method (c) is known as a conventional measure for restricting localized doming of the mask body.

(c) The method is to increase the curvature of the mask body. As is known, it is effective for this method to increase the curvature of the mask body in the short axis thereof.

However, in the technique (a) of providing a graphite layer on the surface of a main surface portion of the mask body, adherence of the graphite layer is deteriorated by a heat treatment repeated in steps of manufacturing a color cathode ray tube, so that the graphite layer easily peels off by a vibration applied to the color cathode ray tube. Small fragments of the layer which peeled off stick to the mask body, thereby clogging electron beam apertures, so that the quality of an image displayed on the phosphor screen is deteriorated. Small fragments of the layer also stick to an electron gun or the vicinity thereof, inducing a spark discharge, so that problems such as a reduction of the withstand voltage characteristic and the like easily occur.

In a method of providing a glass layer made of lead-borate glass or the like on the surface of a main portion of a mask body facing an electron gun as indicated in (b), since a large amount of lead oxide (PbO) is contained in the lead-borate glass, diffused reflection of electron beams shielded by a shadow mask increases in the tube, thereby lowering contrast, normally called whiteout. If a lead-borate glass layer is provided on a mask body made of a cold-rolled plate having a thickness of 0.1 to 0.3 mm, a compressive stress and a tensile stress act on the glass layer due to welding and crystallization. Although a preferable thickness of the glass layer is said to be normally to 10 to 20 $\mu$m, there is a problem that the mask body is deformed if a glass layer having a thickness of 20 $\mu$m or more is formed due to unevenness of manufacturing precision on a mask body made of a cold-rolled plate having a thickness of 0.2 mm or less, for example.

Also, in case of adopting a technique of enlarging the curvature of a main portion of a mask body as in the method (c) in a recent color cathode ray tube with a flattened face panel having an effective portion of a small curvature, the curvature of the inner surface of an effective portion of a shadow mask is small and the curvature of the main surface portion of the mask body is accordingly small throughout from the center of the mask body to the periphery thereof. Therefore, in a flattened color cathode ray tube, an area where doming easily occurs tends to spread to the periphery of longer edges of the mask body.

Further, in order to enlarge the curvature of the main surface portion of the mask body in a flattened color cathode ray tube, the curvature of the inner surface of the effective portion of the face panel must be enlarged. Therefore, particularly in case of a wide color cathode ray tube whose screen has an aspect ratio of 4:3, the difference in thickness between the center portion and the peripheral portion of the face panel is as large as cannot be preferred in view of characteristics. In a normal color cathode ray tube, the heat capacity differs between a main surface portion of the mask body where electron beam apertures are formed and a non-aperture portion where no electron beam apertures are formed, so that a difference in thermal conductivity appears between the main surface portion and the non-aperture portion. Therefore, the mask body has such a temperature distribution that the main surface portion has a very high temperature in relation to the temperature of the non-aperture portion, resulting in that doming in the main surface portion easily becomes large.

DISCLOSURE OF INVENTION

The present invention has been made in view of the above problem, and has an object of providing a color cathode ray tube which is capable of reducing landing drift of electron beams on phosphor layers caused by doming of a shadow mask and is difficult to cause deterioration of color purity.

To achieve the above object, a color cathode ray tube according to the present invention comprises: an envelope including a face panel having an inner surface on which a phosphor screen is formed; a shadow mask provided in the envelope and opposed to the phosphor screen; and an electron gun provided in the envelope, for emitting an electron beam onto the phosphor screen through the shadow mask. The shadow mask includes a mask body in form of a substantially rectangular shape, having a main surface portion opposed to the phosphor screen and having a number of electron beam apertures formed therein, a skirt portion provided around the main surface portion with a non-aperture portion interposed between the main surface portion and the skirt portion, and long and short axes perpendicular to each other, and a mask frame in form of a substantially rectangular shape, equipped on the skirt portion. Further, the skirt portion has a plurality of slit-like openings extended in a direction of the long axis of the mask body or elongated concave portions.

According to the present invention, the non-aperture portion may have a plurality of slit-like openings extended in a direction of the long axis of the mask body or elongated concave portions.

Further, according to the present invention, each of the skirt portion and the non-aperture portion of the mask body has a plurality of slit-like openings extended in a direction of the long axis of the mask body or elongated concave portions.

In the color cathode ray tube constructed in a structure as described above, the openings and the concave portions are formed within a range of about ¼ of a length of the mask body in the direction of the long axis of the mask body, with respect to a center of the range defined at a position distant from the short axis by about ⅓ of the length of the mask body in the direction of the long axis.

In another color cathode ray tube according to the present invention, at least one of the skirt portion and the non-aperture portion has a plurality of circular openings or concave portions a part of which is formed at a high density, and the part has a rectangular shape.

As has been described above, in the color cathode ray tube according to the present invention, the skirt portion of the mask body has openings or concave portions elongated in the long axis direction, and therefore, the rigidity of the skirt portion is lowered. Accordingly, thermal expansion is absorbed by deformation of the skirt portion even if the mask body is heated and thermally expanded by collision of electron beams. It is thus possible to reduce doming of the mask body which causes the main surface portion to expand toward the phosphor screen. As a result, landing drift of electron beams on the phosphor layers can be reduced and deterioration of color purity can be prevented.

Further, if openings or concave portions elongated in the long axis direction are provided at the non-aperture portion of the mask body, the difference in heat conductivity between the main surface portion and the non-aperture portion can be reduced, so that the temperature of the main surface portion is decreased while the temperature of the non-aperture portion is increased, in comparison with a conventional mask body. As a result, the temperature distribution of the entire mask body becomes uniform, and deterioration of color purity caused by landing drift of electron beams onto the phosphor layers can be prevented.

If each of the skirt portion and the non-aperture portion of the mask body is provided with openings or concave portions elongated in the long axis direction, the rigidity of the skirt portion is lowered and the difference in heat conductivity at the boundary portion between the main surface portion and the non-aperture portion can be reduced. Accordingly, it is possible to prevent more effectively deterioration of color purity caused by landing drift of electron beams on the phosphor layers.

Further, openings elongated in the long axis direction or concave portions having a bottom plate thickness smaller than the plate thickness of the mask body are formed in at least one of the skirt portion and the non-aperture portion, within a range of about ¼ of a length of the mask body in the direction of the long axis of the mask body, with respect to a center of the range defined at a position distant from the short axis of the mask body by about ⅓ of the length of the mask body in the direction of the long axis. Therefore, localized doming is reduced at a portion where doming most easily occurs in case of a conventional mask body, and localized deterioration of color purity caused by landing drift of electron beams onto the phosphor layers can be effectively prevented.

BRIEF DESCRIPTION OF DRAWINGS

FIGS. 1 to 6B show a color cathode ray tube according to an embodiment of the present invention:

FIG. 1 is a cross-sectional view of the color cathode ray tube;

FIG. 2 is a perspective view showing a shadow mask body;

FIG. 3 is a cross-sectional view taken along a line III—III in IFG. 2;

FIG. 4 is a side view showing a mask frame partially cut out;

FIG. 5 is a cross-sectional view schematically showing a deformation state of a shadow mask when the mask body is thermally expanded;

FIGS. 6A and 6B are plan views respectively showing flat masks in manufacturing steps with use of different shadow masks;

BEST MODE OF CARRYING OUT THE INVENTION

In the following, a color cathode ray tube according to an embodiment of the present invention will be described in detail with reference to the drawings.

Figure 1:
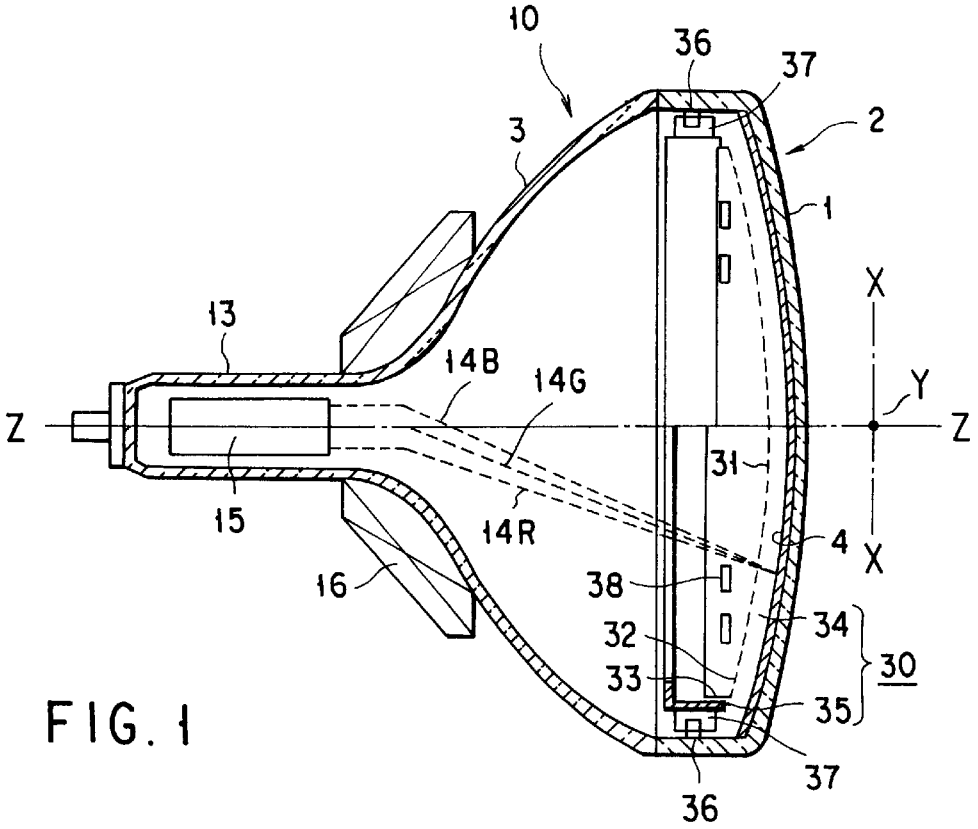

As shown in FIG. 1, a color cathode ray tube comprises a vacuum envelope 10 which includes a face panel 2 having a substantially rectangular effective surface 1 in form of a curved surface, and a funnel 3 connected with the face panel 2. A phosphor screen 4 made of phosphor layers of three colors which respectively radiate in blue, green, and red is formed on the inner surface of the effective portion 1 of the face panel 2. Inside the phosphor screen 4, a substantially rectangular shadow mask 30 described later is provided with a predetermined distance maintained from the face panel. An electron gun 15 which emits three electron beams 14B, 14G, and 14R is provided in a neck 13 of the funnel 3.

Further, in the color cathode ray tube, the three electron beams 14B, 14G, and 14R emitted from the electron gun 15 are deflected by a magnetic field generated by a deflector 16 equipped outside the funnel 3 so that the phosphor screen 4 is scanned horizontally and vertically through the shadow mask 30, thereby displaying a color image.

Figure 2:
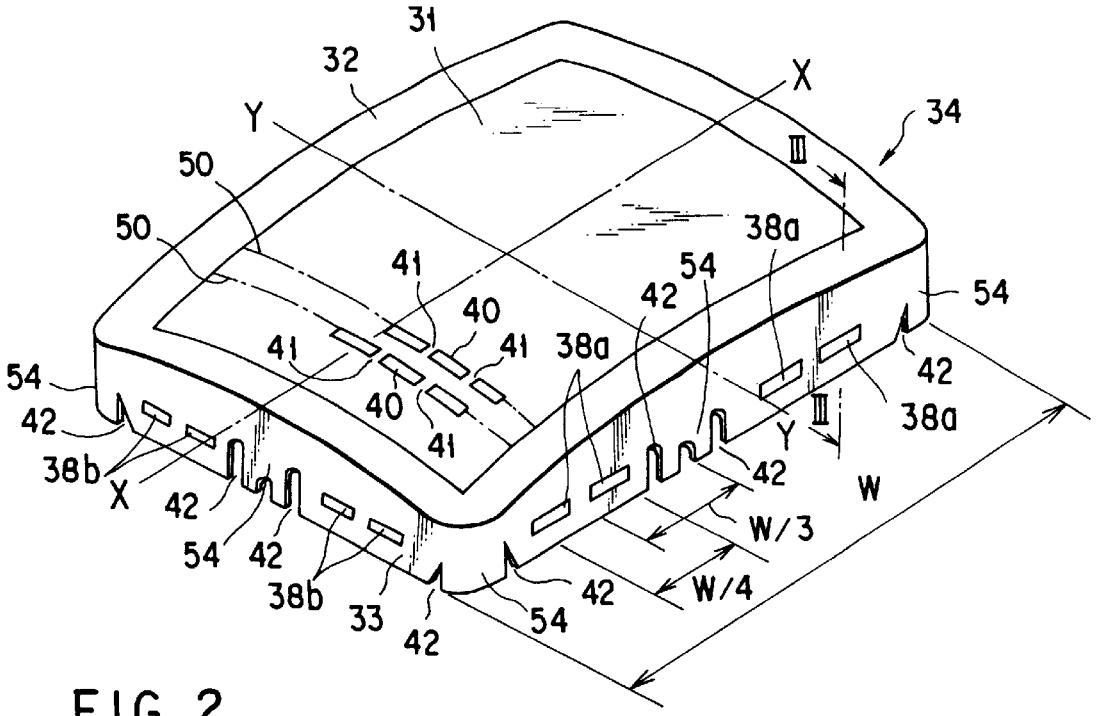

The shadow mask 30 comprises a substantially rectangular mask body 34 and a substantially rectangular mask frame 35 fixed to the peripheral portion of the mask body. As shown in FIG. 2, the mask body 34 is made of a cold-rolled plate having a thickness of 0.1 to 0.3 mm in a substantially rectangular shape and has a long axis (or X-axis) and a short axis (Y-axis) perpendicular to each other. The mask body 34 consists of a main surface portion 31, which is formed to be a curved surface opposed to the phosphor screen 4 and has a number of slit-like electron beam apertures 40, a non-aperture portion 32 surrounding the main surface portion 31, and a skirt portion 33 provided around the main surface portion 31 with the non-aperture portion 32 interposed therebetween.

The electron beam apertures 40 are arranged such that aperture rows 50 extend in the short axis direction Y and are arranged in the long axis direction with predetermined intervals. Each aperture row 50 includes a plurality of apertures 40, and a bridge 41 located between two adjacent apertures 40. In the skirt portion 33, notches 42 opened at the edges of the open end of the skirt portion are formed at the center portions on the long side of the main surface portion 31, at the center portions of the short sides, and at corner portions thereof.

Slit-like openings 38*a* and 38*b* are formed in the skirt portion 33 of the mask body 34. Specifically, a plurality of openings 38*a* elongated in the long axis (or X-axis direction) of the mask body 34 are formed at intermediate portions between the center portion and the corner portions in each of the longer sides of the skirt portion 33, such that the openings 38*a* are disposed in the long axis direction (X-direction) to be adjacent to each other. A plurality of slit-like openings 38*b* elongated in the short axis (or Y-direction) of the mask body 34 are formed at intermediate portions between the center portion and the corner portions in each of the shorter edges of the skirt portion 33, such that the openings 38*b* are disposed in the short axis direction (or Y-direction) to be adjacent to each other.

Among the openings 38*a* and 38*b*, particularly, the openings 38*a* in the longer sides of the skirt portion 33 are provided within a range of about ¼ of the length W of the mask body 34 in the long axis direction (X-direction), with respect to a center of the range which is a position distant by about ⅓ of the length W in the long axis direction from the short axis Y of the mask body 34.

Figure 3:
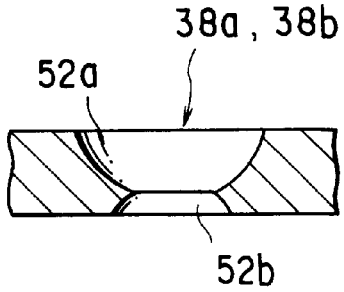

As will be described later, the openings 38*a* and 38*b* are formed by an etching method at the same time when electron beam apertures 40 are formed. As shown in FIG. 3, each of the openings is constituted by a larger opening 52*a* opened to the surface of the skirt portion 33 and a smaller opening 52*b* opened in the back surface of the skirt portion and communicating with the larger opening 52*a*.

Figure 4:
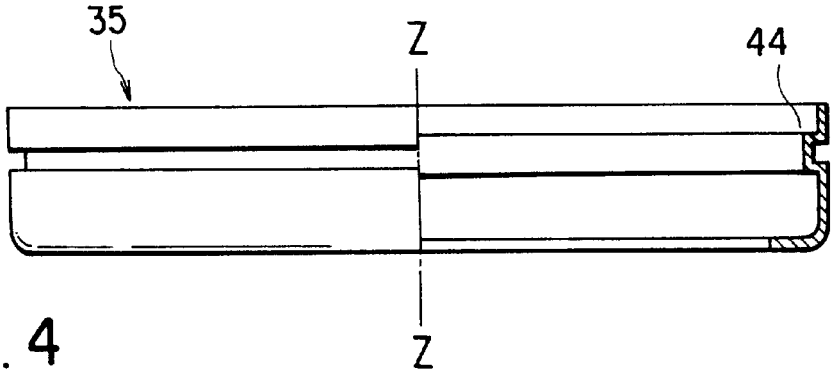

As shown in FIG. 4, the mask frame 35 is made of a cold-rolled plate having a thickness of about 1 mm and is formed in a substantially rectangular shape having a L-shaped cross section. A band-like projecting portion 44 projecting insides from the mask frame 35 is formed on the side-walls of the mask frame, surrounding the entire circumference of the frame. The shadow mask 34 is positioned inside the mask frame 35, and a plurality of tongue portions 54 of the skirt portion 33, each sandwiched between notches 42, are welded to the projecting portion 44 of the mask frame.

As shown in FIG. 1, the shadow mask 30 having a structure as described above is supported inside the face panel 2 by engaging a plurality of stud pins 36 projecting from the inner surface of the skirt portion of the face panel 2, with a plurality of elastic support members 37 equipped on the mask frame 35.

According to the color cathode ray tube constructed as described above, slit-like openings 38*a* and 38*b* are provided in the skirt portion 33 of the mask body 34, so that the skirt portion 33 can have lower rigidity, in comparison with a conventional mask body having a skirt portion not provided with openings. Consequently, when the mask body 34 is heated and expanded thermally by collision of electron beams, the thermal expansion of the mask body 34 can be absorbed by deformation of the skirt portion 33. Therefore, it is possible to reduce doming in which the main surface portion 31 expands toward the phosphor screen, and to reduce landing drift of electron beams on the three color phosphor layers. As a result, deterioration of color purity can be prevented.

If no slit-like openings are provided in the skirt portion of the mask body, the rigidity of the skirt portion is relatively high so that doming is caused thereby thermally expanding the main surface portion toward the phosphor screen when the mask body is heated by collision of electron beams. Consequently, landing drift of electron beams on the three color phosphor layers becomes large and causes deterioration of color purity.

On the contrary, according to the present embodiment, slit-like openings 38*a* and 38*b* are provided in the skirt portion 33 of the mask body 34, so that the rigidity of the skirt portion 33 is low. In addition, since the openings 38*a* and 38*b* extend substantially in parallel with edges of the main surface portion 31, continuity of skirt material in the direction from the main surface portion to the skirt portion 33 is lowered, thereby reducing thermal conductivity in this direction. Therefore, a flow of heat from the periphery of the main surface portion 31 to the skirt portion 33 to the mask frame 35 is relatively decreased, so that the temperature difference between a center portion and a peripheral portion of the main surface 31 can be reduced. As a result, the heat distribution in the main surface portion 31 can be uniform and localized thermal expansion can be restricted in the center portion of the main surface portion 31.

Figure 5:
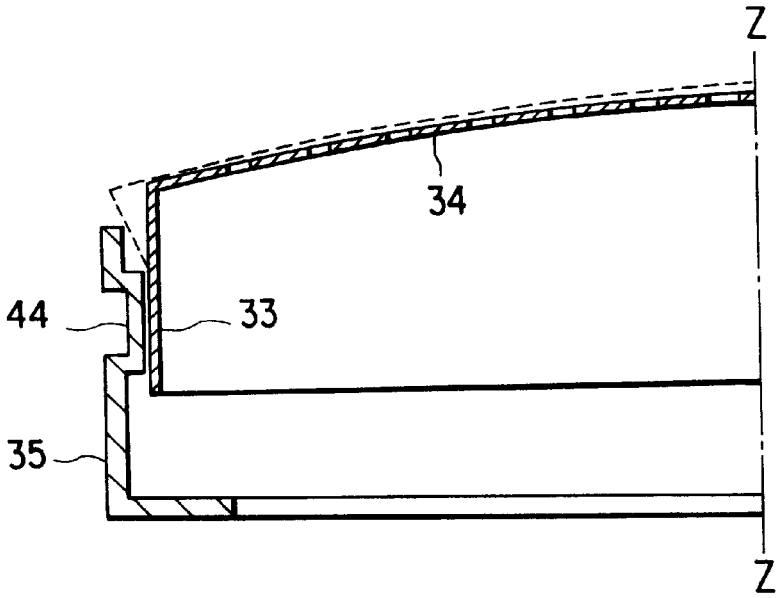

From the above and as shown in FIG. 5, if the mask body 34 is heated by collision of electron beams, thermal expansion caused therefrom is absorbed by deformation of the skirt portion 33 as indicated by a broken line, and doming in which the main surface portion 31 expands toward the phosphor screen 4 is reduced. Therefore, landing drift of electron beams on the three color phosphor layers can be reduced and deterioration of color purity can be prevented. In addition, since slit-like openings 38*a* and 38*b* are provided substantially in parallel with edges of the main surface portion 31, frictional resistance is increased during bulge molding in which the skirt portion 33 is pressed, and the shaping feasibility is improved.

Even when the openings 38*a* and 38*b* are provided in the skirt portion 33 of the mask body 34, the edges of the open end of the skirt portion 33 are continuous to each other, so that there are no difficulties in insertion of the skirt portion 33 into the mask frame 35 during assembly but the shadow mask can be so easily assembled as in a conventional shadow mask.

Like a conventional mask body, the mask body 34 constructed as described above is manufactured in a manner in which electron beam apertures 40 and slit-like openings 38*a* and 38*b* are simultaneously formed in a plate-like flat mask by a photoetching method and the flat mask is subjected to press molding.

Figure 6A:
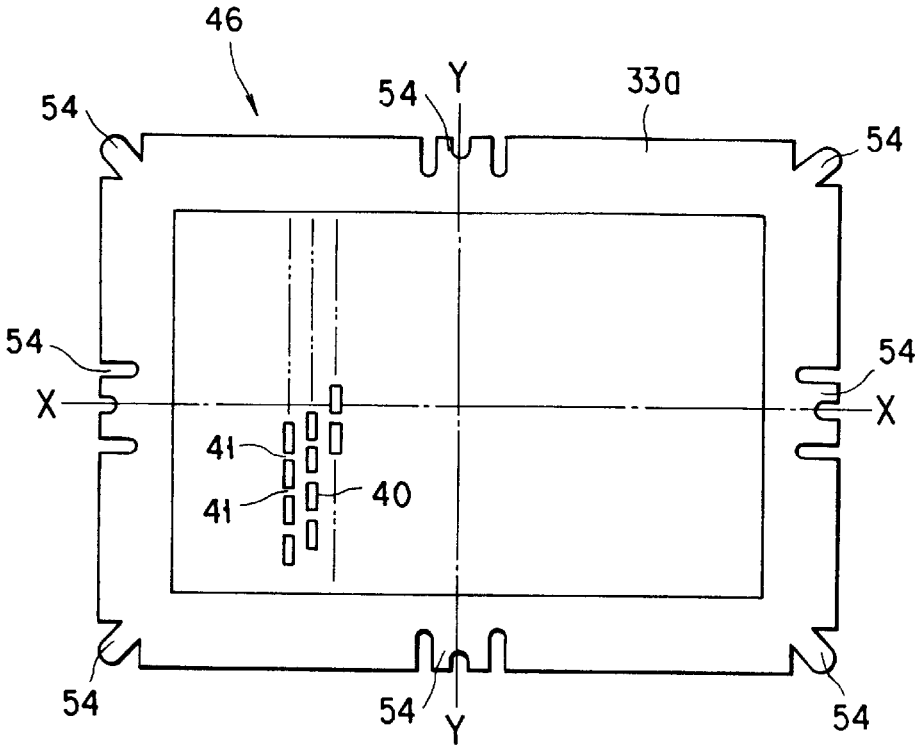
Figure 6B:
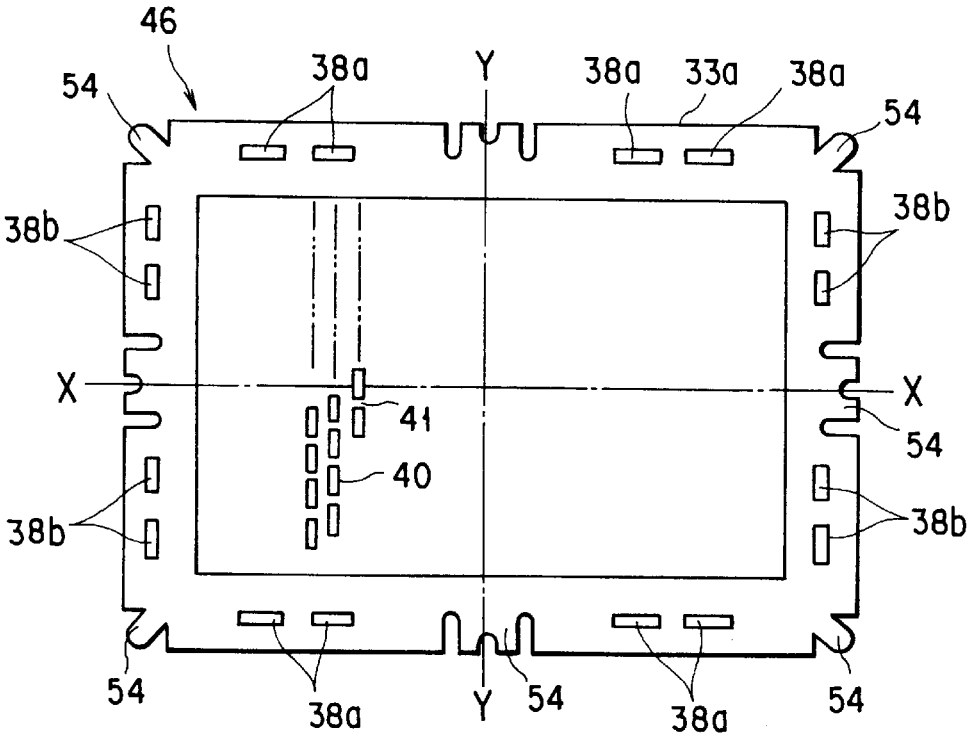

Otherwise, as shown in FIG. 6A, electron beam apertures 40 are formed in a flat mask 46 by a photoetching method, and thereafter, slit-like openings 38*a* and 38*b* are formed at a portion to form a skirt portion by punching processing, as shown in FIG. 6B.

In the embodiment as described above, slit-like openings are provided at the skirt portion 33 of the mask body 34. However, the slit-like openings may be replaced with elongated concave portions having a bottom plate thickness smaller than the thickness of the skirt portion, i.e., the thickness of the mask body. In case of using such elongated concave portions, the rigidity of the skirt portion can be reduced and it is possible to obtain a color cathode ray tube having the same effects as the embodiment described above.

Figure 7:
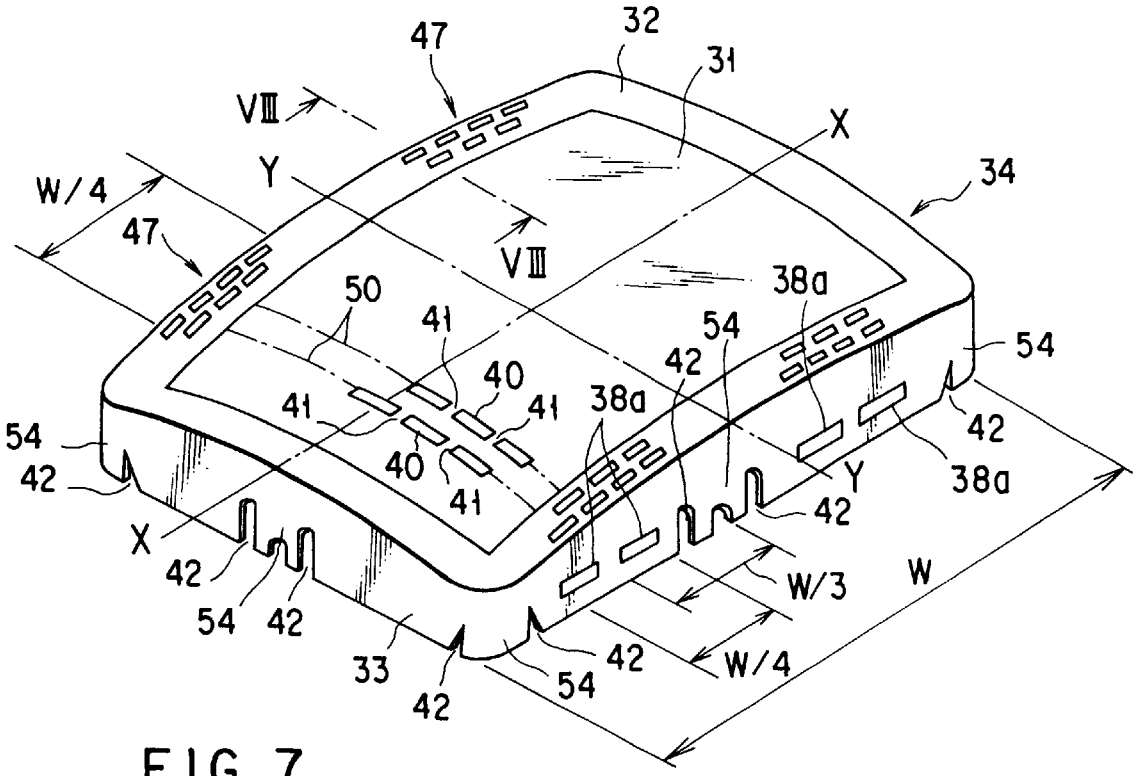
FIG. 7 is a perspective view showing a shadow mask body of a color cathode ray tube according to a second embodiment of the present invention.

FIG. 7 shows a structure of a mask body 34 in a color cathode ray tube according to a second embodiment of the invention. The mask body 34 is made of a cold-rolled plate having a thickness of 0.1 to 0.3 mm in a substantially rectangular shape. The mask body 34 comprises a substantially rectangular main surface portion 31 where a number of slit-like electron beam apertures 40 are formed, a non-aperture portion 32 surrounding the main surface portion 31, and a skirt portion 33 provided around the main surface portion 31 with the non-aperture portion 32 interposed therebetween. A plurality of notches 42 are provided at center portions and corners at longer and shorter edges of the skirt portion 33.

Figure 8:
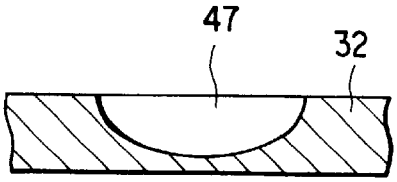
FIG. 8 is a cross-sectional view cut along a line VIII—VIII in FIG. 7.

In the non-aperture portion 32 at the longer edges of the mask body 34, a plurality of elongated concave portions 47 are formed within a range of about ¼ of the length W of the mask body 34 in the long axis direction (X-direction), with respect to a center of the range which is a position distant by about ⅓ of the length W in the long axis direction from the short axis Y of the mask body 34. As shown in FIG. 8, the concave portions 47 have a bottom plate thickness smaller than the plate thickness of the non-aperture portion 32, i.e., than the plate thickness of the mask body 34, and extend in the long axis direction (or X-direction) of the mask body 34, such that the concave portions 47 are disposed to be adjacent to each other along the long axis direction (or X-direction).

In the skirt portion 33 at the longer edges of the mask body 34, slit-like openings 38*a* are formed within a range of about ¼ of the length W of the mask body 34 in the long axis direction (X-direction), with respect to a center of the range which is a position distant by about ⅓ of the length W in the long axis direction from the short axis Y of the mask body 34. The openings 38*a* extend in the long axis direction (or X-direction) of the mask body 34, such that the concave portions 47 are disposed to be adjacent to each other along the long axis direction (or X-direction).

The rest of the structure is the same as that of the embodiment described before. The same components as those in the former embodiment are denoted by the same reference symbols and detailed explanation thereof will be omitted herefrom.

A mask body 34 as described above is manufactured in a manner in which a plate-like flat mask is formed by a photoetching method and the flat mask is there-after subjected to press molding. By etching the flat mask from both sides thereof, electron beam apertures are formed in a portion to form a main surface portion opposed to a phosphor screen, and simultaneously, slit-like openings 38*a* are formed in a portion to form a skirt portion. In addition, by etching the flat mask on one surface, concave portions 47 are formed in a portion to form non-aperture portion 32.

Otherwise, the mask body 34 may be manufactured by a method in which concave portions 47 are formed in a portion to form a non-aperture portion by etching the flat mask on one surface, and thereafter, slit-like openings are formed in a portion to form a skirt portion of the flat mask by punching process.

Figure 9:
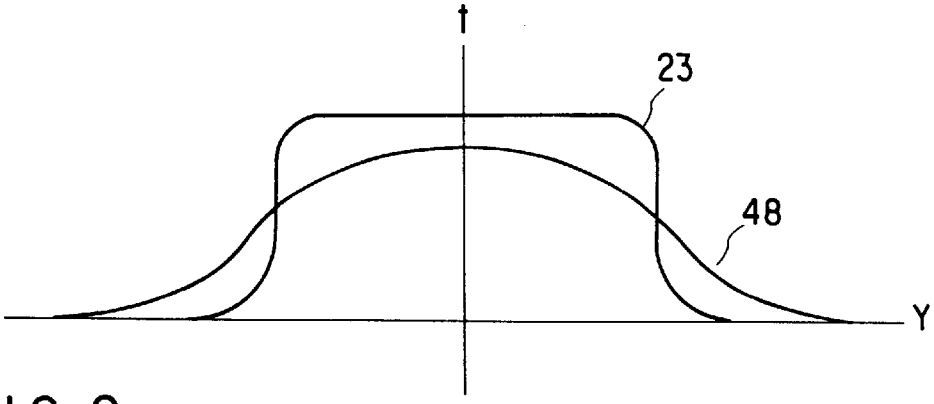
FIG. 9 is a graph showing a temperature distribution in the mask body.

According to the mask body 34 constructed in a structure as described above, since concave portions 47 elongated in the long axis direction (or X-direction) of the mask body are formed in the non-aperture portion at the longer edges, the temperature distribution of the entire mask body can be substantially uniform even if the mask body is heated by collision of electron beams. In FIG. 9, the curve 48 indicates the temperature distribution of the mask body where the lateral axis represents a position along the short axis Y of the mask body and the longitudinal axis represents a temperature t.

Specifically, in case of a mask body which does not have elongated concave portions at the non-aperture portion, the heat capacity differs between a main surface portion where electron beam apertures are formed and the non-aperture portion, so that a difference in thermal conductivity exists between the main surface portion and the non-aperture portion. As indicated by the curve 23 in FIG. 9, the main surface portion has a very high temperature compared with the temperature of the non-aperture portion. As a result, doming is enlarged in the main surface portion.

In contrast, according to the present embodiment, since elongated concave portions 47 are formed in the non-aperture portion 32, the difference in thermal conductivity between the main surface portion 31 and the non-aperture portion 32 is reduced, so that the temperature of the main surface is decreased while the temperature of the non-aperture portion is increased on the contrary. As a result, the temperature distribution over the entire mask body 34 becomes uniform. Such a uniform temperature distribution of a mask body is further assisted by forming slit-like openings 38*a* elongated in the long axis direction (or X-direction), at the skirt portion 33. In addition, the openings 38*a* of the skirt portion 33 lower the rigidity of the skirt portion and absorb thermal expansion of the mask body 34, thereby reducing doming in which the main surface 31 expands toward the phosphor screen, like the mask body of the embodiment described before. Accordingly, by constructing the mask body 34 in a structure as described above, doming of the mask body can be much effectively reduced by the uniform temperature distribution and the lowered rigidity of the skirt portion, so that deterioration of color purity can be eliminated.

In addition, a plurality of concave portions 47 at the non-aperture portion 32 and openings 38*a* at the skirt portion 33 are formed within a range of about ¼ of the length W of the mask body 34, with respect to a center of the range which is a position distant by about ⅓ of the length W in the long axis direction from the short axis Y of the mask body 34. Therefore, it is possible to reduce localized doming at a portion where doming most easily occurs in case of a conventional cathode ray tube, and landing drift of electron beams on a corresponding portion of the phosphor layer can be reduced effectively. This is particularly advantageous for a flattened color cathode ray tube in which the curvature of an effective portion of a face panel is small like in a recent color cathode ray tube, because it is difficult to enlarge the curvature of a mask body of a flattened color cathode ray tube.

In the second embodiment described above, slit-like openings 38*a* are provided at the skirt portion 33 of the mask body 34 and elongated concave portions 47 are provided at the non-aperture portion 32. However, a shadow mask having same advantages as the second embodiment can be attained by providing slit-like openings in place of the concave portions at the non-aperture portion.

If slit-like openings are thus provided at both of the non-aperture portion and the skirt portion, the difference in heat conductivity between the main surface portion 31 and the non-aperture portion 32 can be much more reduced and a greater advantage can be obtained in comparison with a shadow mask in which elongated concave portions are formed in either the non-aperture portion or the skirt portion.

As for a color cathode ray tube incorporating the shadow mask as described above, landing drift on three color phosphor layers was actually measured, and it was found that landing drift at a point on the long axis of the phosphor screen could be improved by about 10% in comparison with a conventional color cathode ray tube.

In addition, in the second embodiment, elongated concave portions may be provided in place of slit-like openings 3*a* of the skirt portion 33. In case where elongated concave portions are thus provided at both of the skirt portion 33 and the non-aperture portion 32, the same advantages as those in the second embodiment can be obtained.

Further, in the second embodiment, elongated concave portions may be provided in place of slit-like openings at the skirt portion 33, while slit-like openings may be formed in place of concave portions 47 at the non-aperture portion 32.

Figure 10:
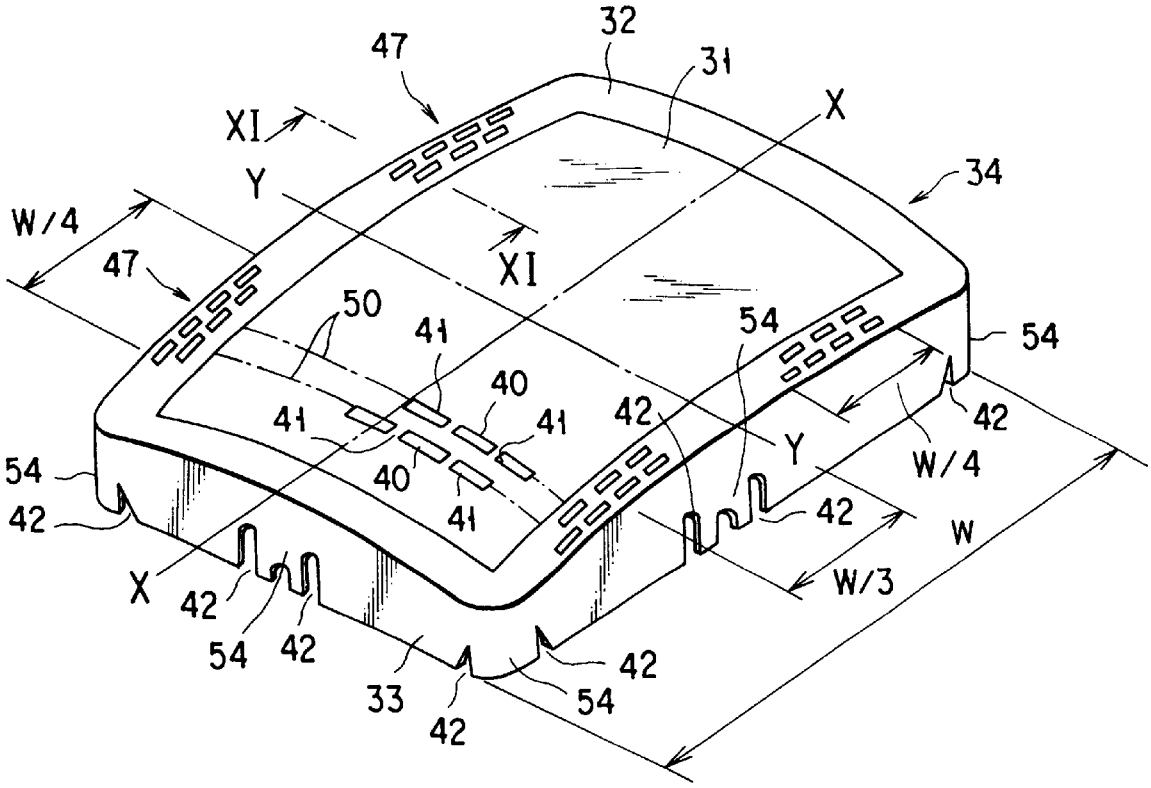
FIG. 10 is a perspective view showing a shadow mask body in a color cathode ray tube according to a third embodiment of the present invention.

FIG. 10 shows a shadow mask body of a color cathode ray tube according to a third embodiment of the present invention. The mask body 34 is made of a cold-rolled plate having a thickness of 0.1 to 0.3 mm in substantially rectangular shape, like the mask body of the first embodiment, and comprises a rectangular main surface portion 31 where a number of slit-like electron beam apertures 40 are formed, a non-aperture portion 32 surrounding the main surface portion 31, and a skirt portion provided around the main surface portion 31 with the non-aperture portion 32 interposed therebetween. A plurality of notches 42 opened at edges of the open end of the skirt portion are provided at center portions and corner portions of the skirt portion 33 at the longer and shorter edges.

Figure 11:
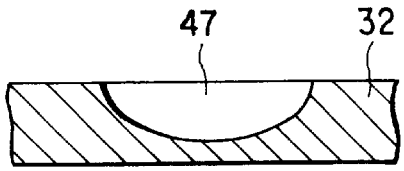
FIG. 11 is a cross-sectional view cut along a line XI—XI in FIG. 10.

In the non-aperture portion 32 at the longer edges of the mask body 34, a plurality of elongated concave portions 47, which have a bottom plate thickness smaller than the plate thickness of the aperture portion 32, i.e., than the plate thickness of the mask body 34 and are elongated in the long axis direction (or X-direction) of the mask body 34, are formed within a range of about ¼ of the length W of the mask body 34 in the long axis direction, with respect to a center of the range which is a position distant by about ⅓ of the length W in the long axis direction from the short axis Y of the mask body 34, as shown in FIG. 11. The rest of the structure is the same as that of the embodiments described before. Those components which are the same as those shown in the foregoing embodiments are denoted by same reference symbols, and detailed explanation thereof will be omitted herefrom.

If concave portions 47 are thus provided simply at the non-aperture portion, the difference in thermal conductivity between the main surface portion 31 and the non-aperture portion 32 is reduced, so that the temperature of the main surface portion 31 is higher while the temperature of the non-aperture portion 32 is lower on the contrary, compared with a conventional mask body. Accordingly, the temperature distribution over the entire mask body 34 can be uniform. As a result, localized doming can be reduced at a portion where doming most easily occurs when a high-luminance image is locally displayed in a conventional mask body, and landing drift of electron beams on phosphor layers can be reduced.

In the third embodiment described above, slit-like openings may be provided in place of elongated concave portions 47 at the non-aperture portion 32 of the mask body 34. In this case, a shadow mask having the same advantages as the third embodiment can be obtained.

Figure 12:
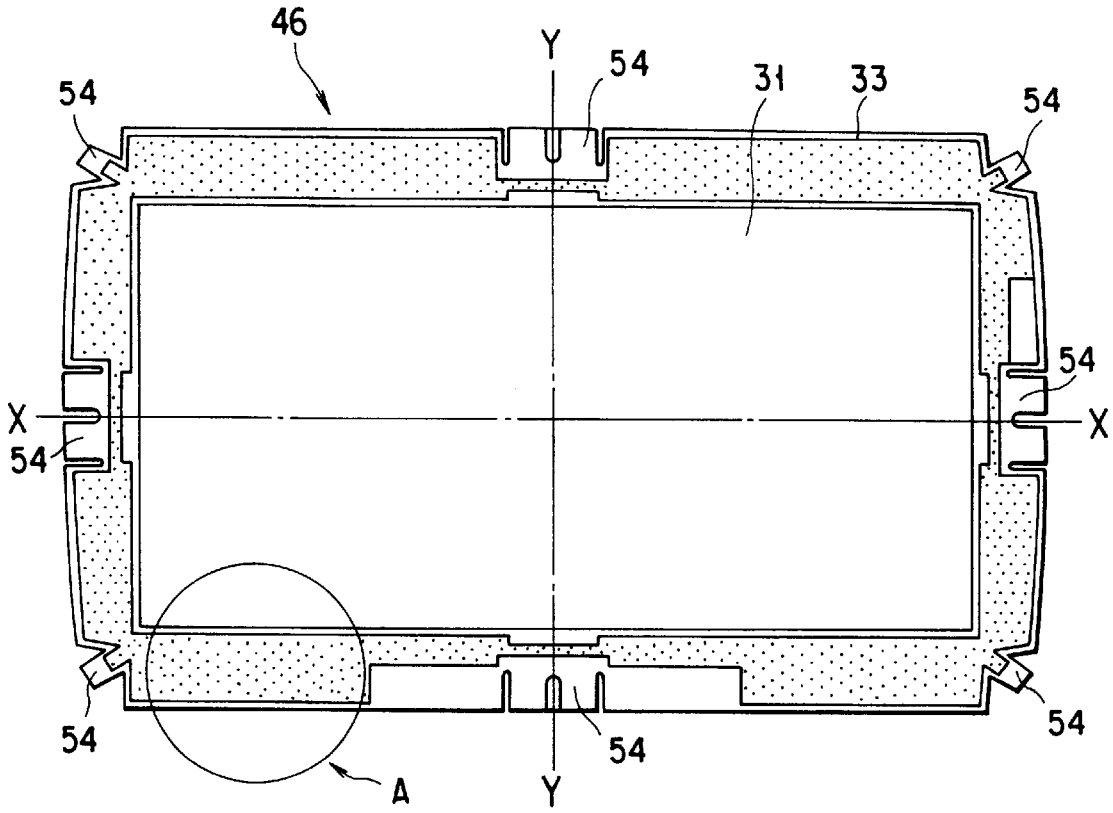
FIG. 12 is a plan view of a flat mask used for manufacturing the shadow mask body in the color cathode ray tube according to the third embodiment.
Figure 13:
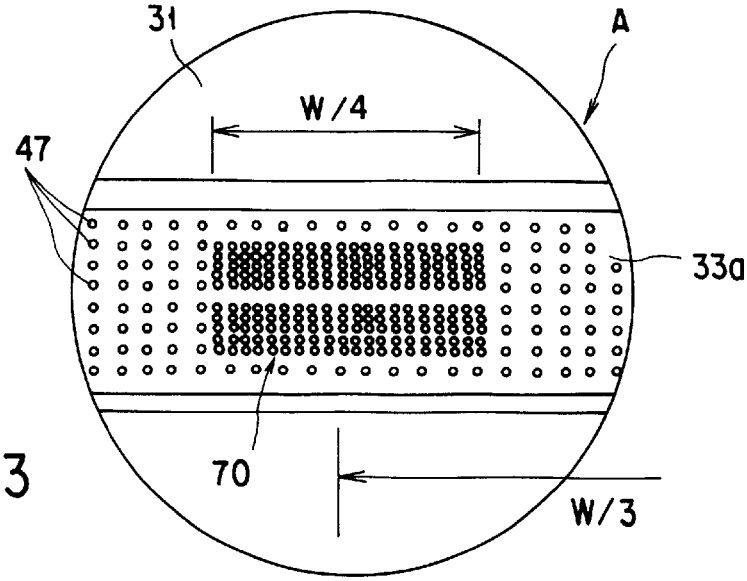
FIG. 13 is a plan view showing an enlarged portion A in FIG. 12.

Meanwhile, concave portions 47 provided at the skirt portion 33 or the non-aperture portion 32 are not limited to those having a rectangular shape but may have a circular shape. FIGS. 12 and 13 show a flat mask 46 before molding of a mask body, and a number of circular concave portions 47 are formed over the entire surface of a portion 33*a* to form a skirt portion. Further, in the portion 33*a* at a longer edge of the main surface portion 31, a high density portion 70 where concave portions 47 are concentrated is provided in a area which is distant from the short axis Y of the mask body by ⅓ of the length W of the mask body. The high-density portion is arranged in a rectangular shape extending substantially in parallel with the long axis X of the mask body and is set to have a length of about ¼ of the length W.

In case of using a mask body constructed as described above, it is possible to obtain the same advantages as those of the embodiments described before. In addition, the same advantages can be obtained if circular openings are provided in place of concave portions 47. Further, in the embodiments described before, circular concave portions shown in FIGS. 12 and 13 may be provided in place of elongated concave portions 47 formed at the non-aperture portion of the mask body, and a rectangular high-density portion 70 where concave portions are concentrated may be provided partially.

What is claimed is:

1. A color cathode ray tube comprising:

an envelope including a face panel having an inner surface on which a phosphor screen is formed;

a shadow mask provided in the envelope and opposed to the phosphor screen; and an electron gun provided in the envelope, for emitting electron beams onto the phosphor screen through the shadow mask, the shadow mask including:

a mask body in a form of a substantially rectangular shape, having a main surface portion opposed to the phosphor screen and having a number of electron beam apertures formed therein, a skirt portion provided around the main surface portion with a non-aperture portion interposed between the main surface portion and the skirt portion, and long and short axes perpendicular to each other, and a mask frame in a form of a substantially rectangular shape, equipped around the skirt portion, and the skirt portion including longer sides which extend in a direction substantially in parallel to the long axis of the mask body, each of the longer sides having a plurality of at least one of elongated openings and elongated concave portions wherein the elongation of the openings and concave portions extend in a direction substantially in parallel to the long axis of the mask body.

2. A color cathode ray tube according to claim 1, wherein the openings or the concave portions are formed- within a range of about ¼ of a length of the mask body in the direction of the long axis of the mask body, with respect to a center of the range defined at a position distant from the short axis by about ⅓ of the length of the mask body in the direction of the long axis.

3. A color cathode ray tube comprising:

an envelope including a face panel having an inner surface on which a phosphor screen is formed;

a shadow mask provided in the envelope and opposed to the phosphor screen; and an electron gun provided in the envelope, for emitting electron beams onto the phosphor screen through the shadow mask, the shadow mask including:

a mask body in a form of a substantially rectangular shape, having a main surface portion opposed to the phosphor screen and having a number of electron beam apertures formed therein, a skirt portion provided around the main surface portion with a non-aperture portion interposed between the main surface portion and the skirt portion, and long and short axes perpendicular to each other, and a mask frame in a form of a substantially rectangular shape, equipped around the skirt portion, and the non-aperture portion including longer sides which extend in a direction substantially in parallel to the long axis of the mask body, each of the longer sides having a plurality of at least one of elongated openings and elongated concave portions wherein the elongation of the openings and concave portions extend in a direction substantially parallel to the long axis of the mask body, the plurality of at least one of openings and concave portions being formed within a range of about ¼ of a length of the mask body in the direction of the long axis of the mask body, with respect to a center of the range defined at a position distant from the short axis by about ⅓ of the length of the mask body in the direction substantially in parallel to the long axis.

4. A color cathode ray tube comprising:

an envelope including a face panel having an inner surface on which a phosphor screen is formed;

a shadow mask provided in the envelope and opposed to the phosphor screen; and an electron gun provided in the envelope, for emitting electron beams onto the phosphor screen through the shadow mask, the shadow mask including:

a mask body in a form of a substantially rectangular shape, having a main surface portion opposed to the phosphor screen and having a number of electron beam apertures formed therein, a skirt portion provided around the main surface portion with a non-aperture portion interposed between the main surface portion and the skirt portion, and long and short axes perpendicular to each other, and a mask frame in a form of a substantially rectangular shape, equipped around the skirt portion, and each of the skirt portion and the non-aperture portion of the mask body including longer sides which extend in a direction substantially in parallel to the long axis of the mask body, each of the longer sides having a plurality of at least one of elongated openings and elongated concave portions wherein the elongation of the openings and concave portions extends in a direction substantially in parallel to the long axis of the mask body.

5. A color cathode ray tube comprising:

an envelope including a face panel having an inner surface on which a phosphor screen is formed;

a shadow mask provided in the envelope and opposed to the phosphor screen; and an electron gun provided in the envelope, for emitting electron beams onto the phosphor screen through the shadow mask, the shadow mask including:

a mask body in a form of a substantially rectangular shape, having a main surface portion opposed to the phosphor screen and having a number of electron beam apertures formed therein, a skirt portion provided around the main surface portion with a non-aperture portion interposed between the main surface portion and the skirt portion, and long and short axes perpendicular to each other, and a mask frame in a form of a substantially rectangular shape, equipped on the skirt portion, and the skirt portion having a region wherein a plurality of at least one of circular openings and circular concave portions are formed, the region including a substantially rectangular high density portion wherein the openings or concave portions are formed with density higher than another portion of the region.

6. A color cathode ray tube according to claim 5, wherein the high density portion is formed within a range of about ¼ of a length of the mask body in the direction of the long axis of the mask body, with respect to a center of the range defined at a position distant from the short axis by about ⅓ of the length of the mask body in the direction of the long axis.

7. A color cathode ray tube according to claim 5, wherein the high density portion is formed within a range of about ¼ of a length of the mask body in the direction of the long axis of the mask body, with respect to a center of the range defined at a position distant from the short axis by about ⅓ of the length of the mask body in the direction of the long axis.

8. A color cathode ray tube comprising:

an envelope including a face panel having an inner surface on which a phosphor screen is formed;

a shadow mask provided in the envelope and opposed to the phosphor screen; and an electron gun provided in the envelope, for emitting electron beams onto the phosphor screen through the shadow mask, the shadow mask including:

a mask body in a form of a substantially rectangular shape, having a main surface portion opposed to the phosphor screen and having a number of electron beam apertures formed therein, a skirt portion provided around the main surface portion with a non-aperture portion interposed between the main surface portion and the skirt portion, and long and short axes perpendicular to each other, and a mask frame in a form of a substantially rectangular shape, equipped around the skirt portion, and the non-aperture portion having a region wherein a plurality of at least one of circular openings and circular concave portions are formed, the region including a substantially rectangular high density portion wherein the openings or concave portions are formed with density higher than another portion of the region.

9. A color cathode ray tube according to claim 8, wherein the high density portion is formed within a range of about ¼ of a length of the mask body in the direction of the long axis of the mask body, with respect to a center of the range defined at a position distant from the short axis by about ⅓ of the length of the mask body in the direction of the long axis.

10. A color cathode ray tube comprising:

an envelope including a face panel having an inner surface on which a phosphor screen is formed;

a shadow mask provided in the envelope and opposed to the phosphor screen; and an electron gun provided in the envelope, for emitting electron beams onto the phosphor screen through the shadow mask, the shadow mask including:

a mask body in a form of a substantially rectangular shape, having a main surface portion opposed to the phosphor screen and having a number of electron beam apertures formed therein, a skirt portion provided around the main surface portion with a non-aperture portion interposed between the main surface portion and the skirt portion, and long and short axes perpendicular to each other, and a mask frame in a form of a substantially rectangular shape, equipped around the skirt portion, and each of the skirt portion and the non-aperture portion having a region wherein a plurality of at least one of circular openings and circular concave portions are formed, each of the regions including a substantially rectangular high density portion wherein the openings or concave portions are formed with density higher than another portion of the region.

11. A color cathode ray tube according to claim 10, wherein the high density portion is formed within a range of about ¼ of a length of the mask body in the direction of the long axis of the mask body, with respect to a center of the range defined at a position distant from the short axis by about ⅓ of the length of the mask body in the direction of the long axis.

* * * * *